US006397904B1

(12) United States Patent
Erikawa

(10) Patent No.: US 6,397,904 B1
(45) Date of Patent: Jun. 4, 2002

(54) CUP TYPE AUTOMATIC VENDING MACHINE

(75) Inventor: Hajime Erikawa, Saitama-ken (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 09/656,239

(22) Filed: Sep. 6, 2000

(30) Foreign Application Priority Data

Sep. 7, 1999 (JP) ..... 11-252583

(51) Int. Cl.[7] ..... B65B 43/42; B67C 3/00
(52) U.S. Cl. ..... 141/174; 141/168; 141/173
(58) Field of Search ..... 141/168, 173, 141/174, 192, 198

(56) References Cited

U.S. PATENT DOCUMENTS 3,648,889 A * 3/1972 Greaves et al. ..... 221/11
4,480,764 A * 11/1984 Takagi et al. ..... 221/11
4,590,975 A * 5/1986 Credle, Jr. ..... 141/1

FOREIGN PATENT DOCUMENTS

JP 6-92463 4/1994

* cited by examiner

*Primary Examiner*—Timothy L. Maust
(74) *Attorney, Agent, or Firm*—McDermott, Will & Emery

(57) ABSTRACT

A link (20) is moved to a perpendicular (upper) direction based on a driving force F and a pin (22) provided on a link (16A) is moved along a guide groove (23) to a position shown in FIG. 5. Since the link (16A) is pivotally connected to a supporting unit (15) by a pin (14), the pin (22) can be moved along the guide groove (23) to a horizontal direction shown by an arrow without any change of its perpendicular position. By the movement to the horizontal direction, a clockwise rotating power around the pin (14) is generated in the link (16A). According to the cup type automatic vending machine of the invention, a cup transport mechanism can be driven by a small driving force, and the vending machine can be smaller without any deformation and circulation incapability of cups.

19 Claims, 7 Drawing Sheets

1 : MAIN BODY
2A : CUP ACCOMMODATING UNIT
2B : CUP ACCOMMODATING UNIT
2C : CUP ACCOMMODATING UNIT
3A : CUP DISPOSAL OUTLET
3B : CUP DISPOSAL OUTLET
3C : CUP DISPOSAL OUTLET
4 : CUP CHUTE
5A : CUP
6 : CUP STAGE
7 : DRAIN BUCKET

2 : CUP ACCOMMODATING UNIT

5 : PILED CUPS

8A : CUP DUPPLYING UNIT

8B : CUP DUPPLYING UNIT

8C : CUP DUPPLYING UNIT

9 : ENDLESS CONVEYER

10A : CUP TRANSPORT MECHANISM

10B : CUP TRANSPORT MECHANISM

10C : CUP TRANSPORT MECHANISM

11 : HINGE

12 : SUPPLEMENTARY OPENING

5 : PILED CUPS
14 : PIN
15 : SUPPORTING UNIT
16A : LINK
16B : LINK
17A : PIN
17B : PIN
18 : PUSHING MATERIAL
19 : PIN
20 : LINK
21 : DRIVING SLIDER
21A : DRIVING FORCE TRANSMISSION UNIT
22 : PIN

X1 : DISTANCE
X2 : DISTANCE
10A : CUP TRANSPORT MECHANISM
14 : PIN
15 : SUPPORTING UNIT
16A : LINK
17A : PIN
18 : PUSHING MATERIAL
19 : PIN
20 : LINK
21 : DRIVING SLIDER
21A : DRIVING FORCE TRANSMISSION UNIT
22 : PIN

FIG.4

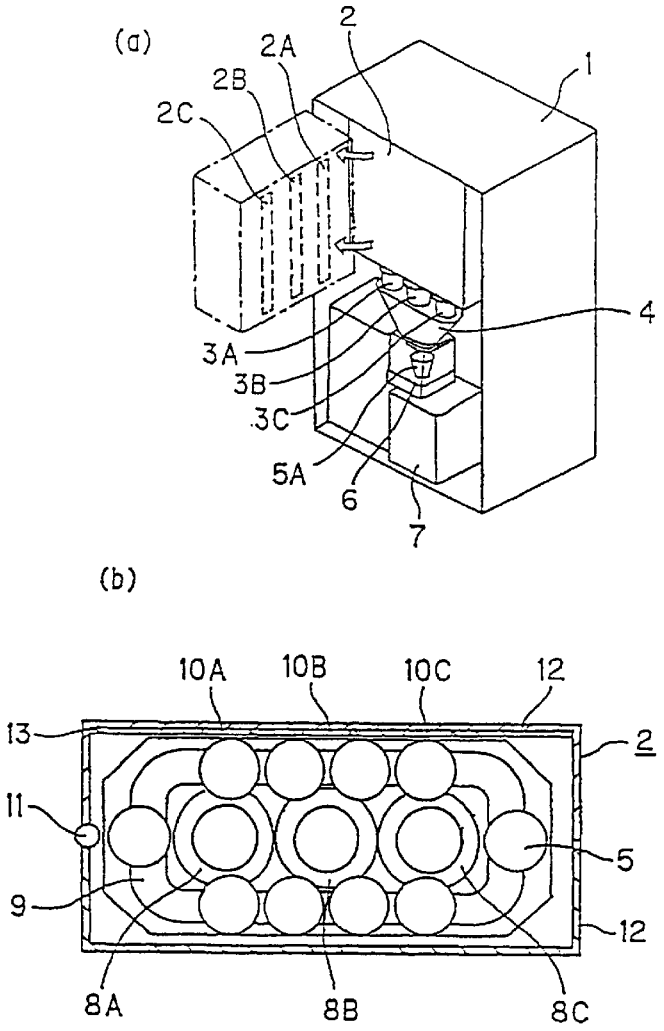

1 : MAIN BODY
2A : CUP ACCOMMODATING UNIT
2B : CUP ACCOMMODATING UNIT
2C : CUP ACCOMMODATING UNIT
3A : CUP DISPOSAL OUTLET
3B : CUP DISPOSAL OUTLET
3C : CUP DISPOSAL OUTLET
4 : CUP CHUTE
5A : CUP
6 : CUP STAGE
7 : DRAIN BUCKET

2 : CUP ACCOMMODATING UNIT
5 : PILED CUPS
8A: CUP DUPPLYING UNIT
8B: CUP DUPPLYING UNIT
8C: CUP DUPPLYING UNIT
9 : ENDLESS CONVEYER
10A : CUP TRANSPORT MECHANISM
10B : CUP TRANSPORT MECHANISM
10C : CUP TRANSPORT MECHANISM
11 : HINGE
12 : SUPPLEMENTARY OPENING
13 : GAP FILL PLATE

X2 : DISTANCE
X3 : DISTANCE
10A : CUP TRANSPORT MECHANISM
14 : PIN
15 : SUPPORTING UNIT
16A : LINK
17A : PIN
18 : PUSHING MATERIAL
19 : PIN
20 : LINK
21 : DRIVING SLIDER
21A : DRIVING FORCE TRANSMISSION UNIT
22 : PIN
23 : GUIDE GROOVE
F : DRIVING FORCE
d : DISTANCE

5 : PILED CUPS

8A: CUP DUPPLYING UNIT (L SIZE)

8B: CUP DUPPLYING UNIT (M SIZE)

8C: CUP DUPPLYING UNIT (S SIZE)

10A : CUP TRANSPORT MECHANISM

10B : CUP TRANSPORT MECHANISM

10C : CUP TRANSPORT MECHANISM

12 : SUPPLEMENTARY OPENING

13 : GAP FILL PLATE

18 : PUSHING MATERIAL

18a : CURVED SURFACE

5 : PILED CUPS
8A: CUP DUPPLYING UNIT
9 : ENDLESS CONVEYER
10A : CUP TRANSPORT MECHANISM
14 : PIN
15 : SUPPORTING UNIT
16A : LINK
16B : LINK
17A : PIN
17B : PIN
18 : PUSHING MATERIAL
19 : PIN
20 : LINK
21 : DRIVING SLIDER
21A : DRIVING FORCE TRANSMISSION UNIT
22 : PIN
23 : GUIDE GROOVE

CUP TYPE AUTOMATIC VENDING MACHINE

FIELD OF THE INVENTION

The present invention relates to a cup type automatic vending machine, and more particularly, relates to a cup type automatic vending machine capable of reducing volume of its cup accommodating unit without any damage to behavior of cup transport mechanism.

BACKGROUND OF THE INVENTION

There has been known a cup type automatic vending machine having a cup accommodating unit in which cups of small (S) size, middle (M) size and large (L) size to fill a drink therein are piled separate from each other in a vertical or perpendicular direction. Upon receiving a vending command, a cup supplying unit of separate sizes provided in the cup accommodating unit is driven to separate a lowermost cup from the piled cups corresponding to a size of the drink to be vended and to supply a counter table (vending outlet) of the vending machine with the cup.

A cup supplying unit separating a cup from the piled cups and supplying it is disclosed in Japanese Patent Publication (unexamined) 92463/1994. According to the cup supplying unit, a cup separation cam having first and second nails holding a hem of the cup is installed in the ring form and is subjected to reciprocal angular movements, whereby the lowermost cup in the piled cups is supplied based on linking actions of the first and second nails.

A conventional cup accommodating unit is shown in FIG. 1, in which the supplementary cups 5 piled independent on S size, M size and L size are accommodated around the cup supplying unit 8A (L size) 8B (M size), 8C (S size) so that they may be circulated. The cup accommodating unit 2 is composed of an endless conveyer 9 to circulate the piled cups 5, a pair of supplementary openings 12, which are supported by a hinge 11 and are opened or closed when the piled cups are supplemented in the cup accommodating unit 2, and a cup transport mechanism 10A, 10B, 10C provided on one of the supplementary openings 12 and horizontally transporting the piled cups 5 on the conveyer 9 to the cup supplying unit 8A, 8B, 8C corresponding to the cup size.

In case that the cups set in the cup supplying unit 8A, 8B, 8C are exhausted (sold out), a cup exhausting (sold out) signal is output to a vending control unit by a sensor provided in the cup supplying unit, and the cup transport mechanism 10A, 10B, 10C in the cup accommodating unit 2 is driven in accordance with the cup sold out signal, whereby the piled cups 5 for supplement having a desired size are moved to the cup supplying unit 8A, 8B, 8C. A parallel rule mechanism in which a plurality of links are connected to each other by pins has been widely known as the cup transport mechanism 10A, 10B, 10C.

A side view of the cup transport mechanism 10A is shown in FIG. 2, which is composed of links 16A and 16B movably supported by a pin 14 on a supporting unit 15 provided in the cup accommodating unit 2, a pushing material 18 movably supported by pins 17A and 17B on a free end of the links 16A and 16B, a link 20 connected to the link 16A by a pin 22, and a driving slider 21 connected to the link 20 by a pin 19 and driven in a perpendicular direction along an inner wall of the cup accommodating unit 2. A driving force transmission unit 21A transmitting a driving force by a driving force transmission material (not shown) is provided in the driving slider 21.

However, since the cup transport mechanism is installed in the cup accommodating unit according to conventional cup type automatic vending machines, a volume of the cup accommodating unit is large, causing problems in making it small size. If the cup transport mechanism is made thinner in order to realize a small size of the cup accommodating unit, a horizontal distance X1 between the pin 14 which is a rotating axis of the link 16A and the pin 22 rotating round the pin 14 is smaller as shown in FIG. 3(*a*), whereby a bigger driving force F is necessary in order to make the link 16A clockwise rotation round the pin 14 to the position shown in FIG. 3(*b*). Further, if the volume of the cup accommodating unit is small, the piled cups for supplementary use are close to the cup transport mechanism and therefore, they are contact with each other in the circulation of the piled cups. This causes problems such as deformation of the cups or incapability of the piled cup circulation.

SUMMARY OF THE INVENTION

Therefore, it is an object of the invention to provide a cup type automatic vending machine capable of driving a cup transport mechanism by a small driving force and capable of making the machine small size without causing deformation of the cups or incapability of the piled cup circulation.

The object of the invention can be accomplished by a cup type automatic vending machine with a cup supplement device for supplement by pushing out the piled cups installed in the fixed position to a cup separate unit for supplying a drink supplying unit with the lowermost end cup of the piled cups, said cup supplement device comprising a pushing material to push out the piled cups from the fixed position to the cup separate unit, a link pushing the piled cups to the pushing material, of which one end is movably supported and the other end is movably connected to the pushing material, said link is rotated round the one end in a fixed direction and the pushing material moves by the other end so as to push the piled cups, and a rotating power generating means provided in a fixed position between the ends of the link and rotating the link in a fixed direction by a driving force including a component in a direction perpendicular to the pushing direction of the pushing material.

According to the cup type automatic vending machine as described above, a rotating power is generated to rotate the link in the direction of pushing the plate by the rotating power generating means where a driving force in the direction perpendicular to the pushing direction of the plate is transmitted to the link.

BRIEF DESCRIPTION OF THE DRAWINGS

The cup type automatic vending machine of the invention will be explained in more detail by referring the drawings.

FIG. 3(*b*) is a partial explanatory view showing the initial driving condition in an conventional cup transport mechanism.

FIG. 4(*a*) is a perspective view showing the cup type automatic vending machine which is an embodiment of the invention.

FIG. 4(*b*) is a plan view of the cup accommodating unit of the cup type automatic vending machine which is an embodiment of the invention.

FIG. 5(*b*) is a partial explanatory view showing the initial driving condition in the cup transport mechanism which is an embodiment of the invention.

FIG. 5(*c*) is an explanatory view showing the axis contact condition in the cup transport mechanism shown in FIG. 5(*a*).

FIG. 5(*d*) is an explanatory view showing the axis contact condition in the cup transport mechanism shown in FIG. 5(*b*).

FIG. 7(*b*) is an explanatory view showing the initial driving condition in the cup transport mechanism which is an embodiment of the invention.

DETAILED DESCRIPTION OF THE PREFERRED EMBODIMENT

Figure 1:
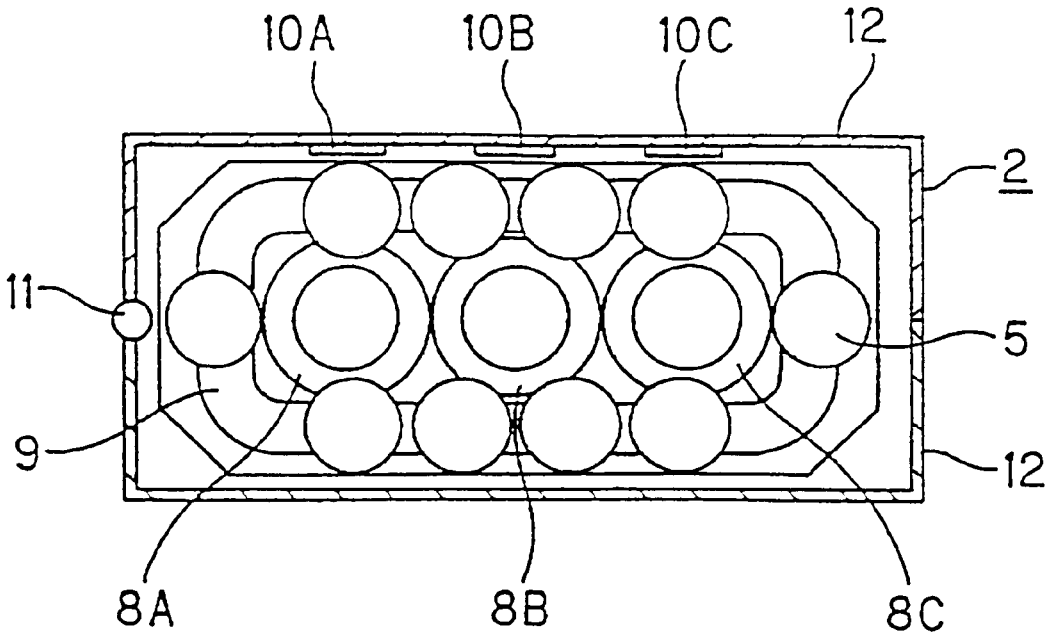
FIG. 1 is a plan view showing a conventional cup accommodating unit.
Figure 2:
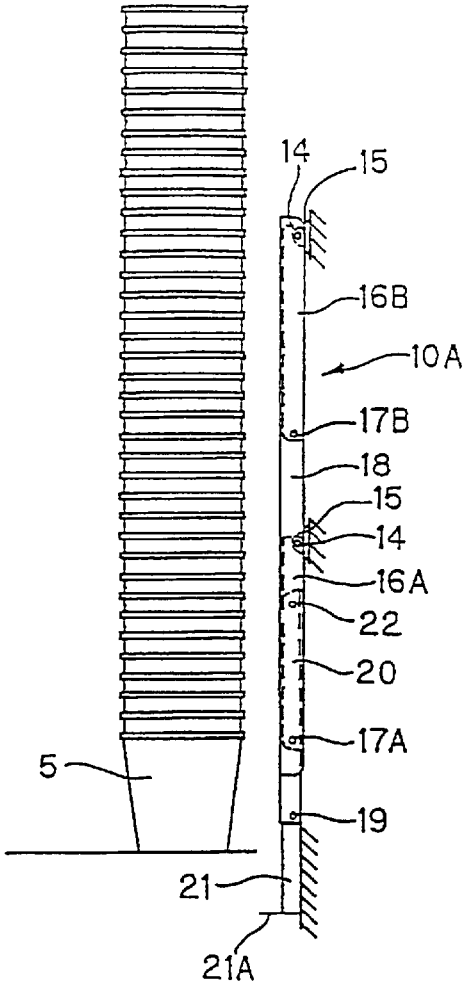
FIG. 2 is a side view showing a conventional cup transport mechanism.
Figure 3:
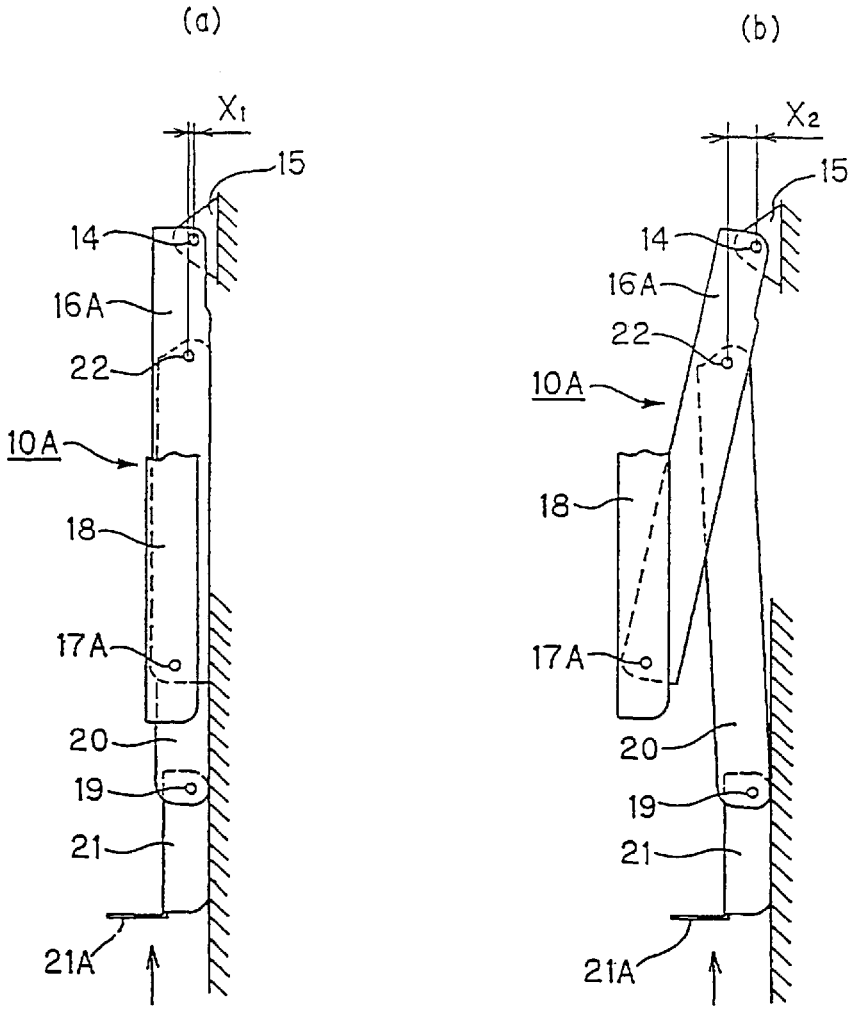
FIG. 3(*a*) is a partial explanatory view showing the waiting condition in a conventional cup transport mechanism.

In FIG. 4(*a*) showing an embodiment of the cup type automatic vending machine in the invention, it includes a cup accommodating unit 2 in an upper portion inside the main body of the vending machine, a cup transport mechanism 10A, 10B, 10C provided in the side wall of the cup accommodating unit 2 corresponding to cup size of S, M, L, a cup disposal outlet 3A, 3B, 3C provided in the lower portion of a plurality of cup supplying units (not shown) separating a cup from the piled cups and provided on each cup size of S, M, L in the cup accommodating unit 2, a cup chute 4 in the oblong and flat hopper form corresponding to the cup disposal outlet, a cup stage 6 on which a cup 5A supplied through the cup chute 4 is installed, and a drain bucket 7 receiving the drink spilled from the cup 5A and provided in the lower portion of the cup stage 6.

In FIG. 4(*b*) showing the cup accommodating unit 2, the piled cups 5 for supplement of size S, Size M, size L are accommodated and circulated around the cup supplying unit 8A (for L size), 8B (for M size), 8C (for S size). The cup accommodating unit 2 includes an endless conveyer 9 circulating the piled cups, a pair of supplementary openings 12 which are supported by a hinge 11 and are open or close when the piled cups 5 are supplemented in the cup accommodating unit 2, a cup transport mechanism 10A, 10B, 10C provided on one of the supplementary openings 12 and horizontally transporting the piled cups 5 on the conveyer 9 to the cup supplying unit 8A, 8B, 8C corresponding to the cup size, and a gap fill plate 13 provided inside the supplementary openings so that its surface may be substantially same plain as that of the cup transport mechanism 10A, 10B, 10C which are extruded to the cup side.

Figure 5:
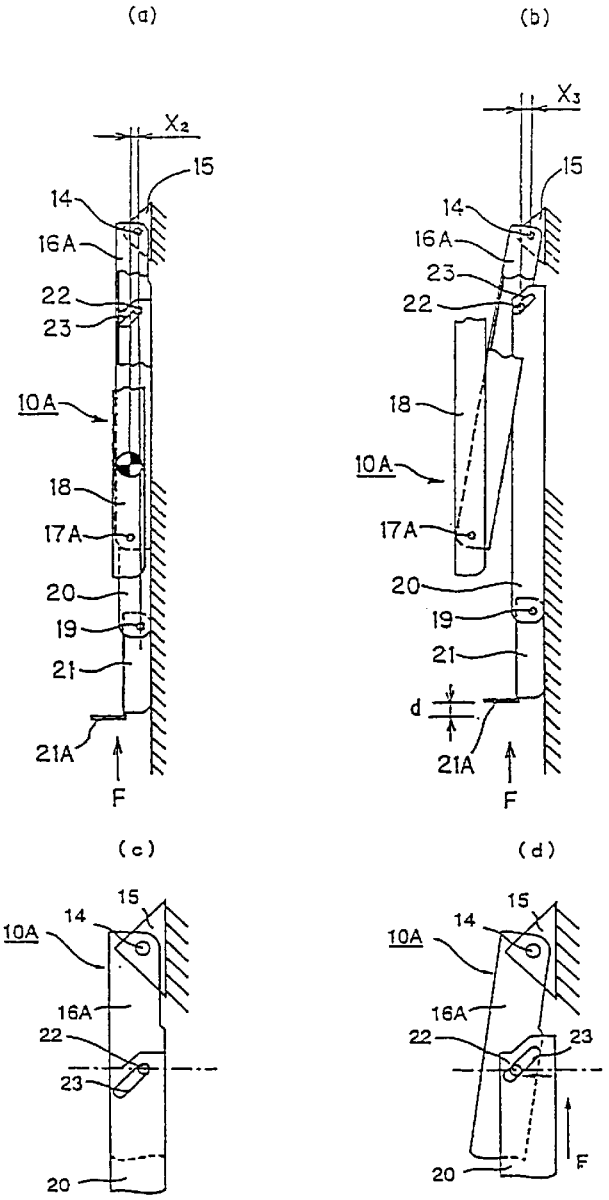
FIG. 5(*a*) is a partial explanatory view showing the waiting condition in the cup transport mechanism which is an embodiment of the invention.

In FIG. 5(*a*) partly showing the cup transport mechanism 10A, link means includes a link 16A movably supported on a supporting unit 15 provided on a fixed position by a pin 14, a pushing material 18 formed in the U-shape and movably supported by a pin 17A on a free end of the link 16A, a link 20 connected to the link 16A by a pin 22, a guide groove 23 movably holding the pin 22 in a fixed direction and provided in the link 20, a driving slider 21 connected to the link 20 by a pin 19 and driven in a perpendicular direction along the fixed position. A pair of the link means are installed in parallel and are connected to the pushing material 18. A driving force transmission unit 21A transmitting a driving force by a driving force transmission material (not shown) is provided in the driving slider 21. The cup transport mechanism 10B, 10C is same construction as the unit 10A.

In case that the pushing material is in the position (waiting position) as shown in FIG. 5(*a*), the center of gravity of the cup transport mechanism 10A, of which position in the horizontal direction is shown in FIG. 5(*a*), is provided at a distance X2 from the pins 14, 22 and 19. In the condition, the pushing material 18 is pushed to the fixed position because counterclockwise rotating power round the pin 14 based on the empty weight of the pushing material 18 and the link 16A is given to the link 16A.

In FIG. 5(*b*), the driving slider 21 moves to a distance "d" in a perpendicular direction by applying a driving force to the driving force transmission unit 21A. The link 20 and the driving slider 21 are elevated to move the pin 22 to the side of the pushing material 18 along the guide groove 23, whereby a horizontal distance X3 between the pin 14 acting as the fulcrum and the pin 22 is more and the moment (driving force F×horizontal distance X) rotating the link 16A round the pin 14.

In FIG. 5(*c*) showing a relationship of the position between the pin 22 and the guide groove 23 shown in FIG. 5(*a*), the pin 22 provided on the link 16A is placed on the uppermost position of the guide groove 23 by empty weight of the link 20, when the cup transport mechanism is in the waiting position.

In FIG. 5(*d*) showing a relationship of the position between the pin 22 and the guide groove 23 shown in FIG. 5(*b*), the link 20 moves to the perpendicular (upper) direction by the driving force F, whereby the pin 22 provided on the link 16A moves along the edge of the guide groove 23 to the position shown in FIG. 5(*d*). Since the link 16A is connected through the axis to the supporting unit 15 by the pin 14, the horizontal position of the pin 22 changes as shown by an arrow but the perpendicular position of the pin 22 does not change when it moves along the guide groove 23. The link 16A is given a clockwise rotating power at the axis of the pin 14.

The pin 22 is provided on the link 16A and the guide groove 23 is provided on the link 20 in the embodiment of the invention, but the guide groove 23 can be provided on the link 16A and the pin 22 can be provided on the link 20.

Figure 6:
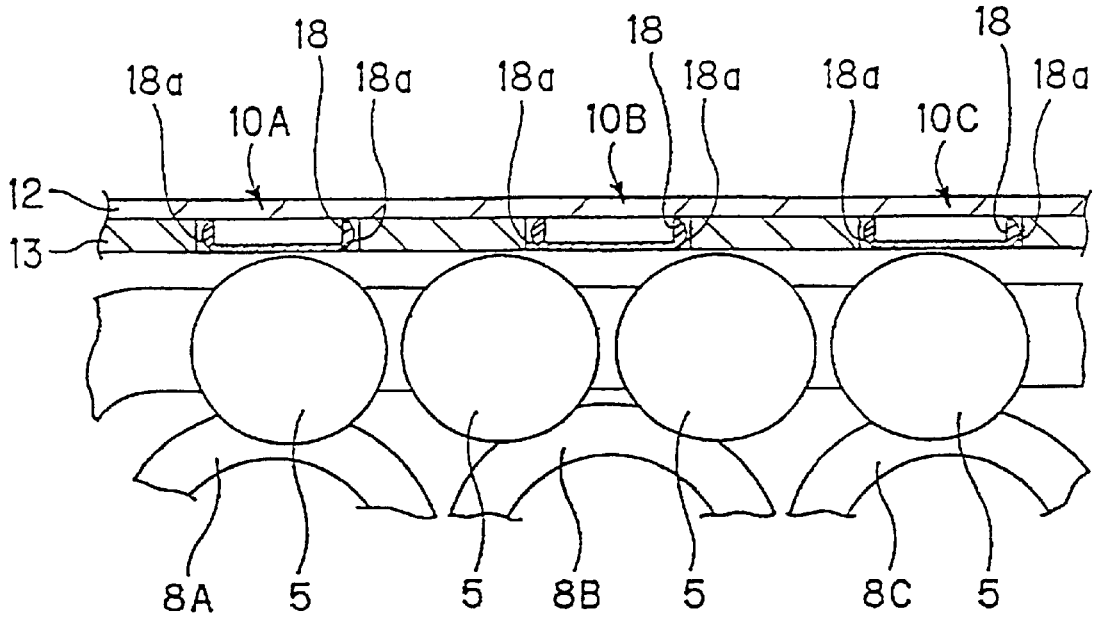
FIG. 6 is a partial plan view showing the cup transport mechanism which is an embodiment of the invention.

In FIG. 6 showing a plan view of the cup transport mechanism in the cup accommodating unit, a corner of the pushing material 18 in the cup transport mechanism 10A, 10B, 10C has a curved surface which is contact with the piled cups 5, whereby cup does not change its shape when the pushing material 18 is contact with the piled cups. Further, the pushing material may have a round corner instead of the curved corner. The cup transport mechanism 10A, 10B, 10C has the flat surface to the cup contact side of the pushing material 18 by the gap fill plate 13, whereby circulation incapability of the piled cups for supplement caused by falling the piled cups 5 in between the cup transport mechanism can be prevented.

Figure 7:
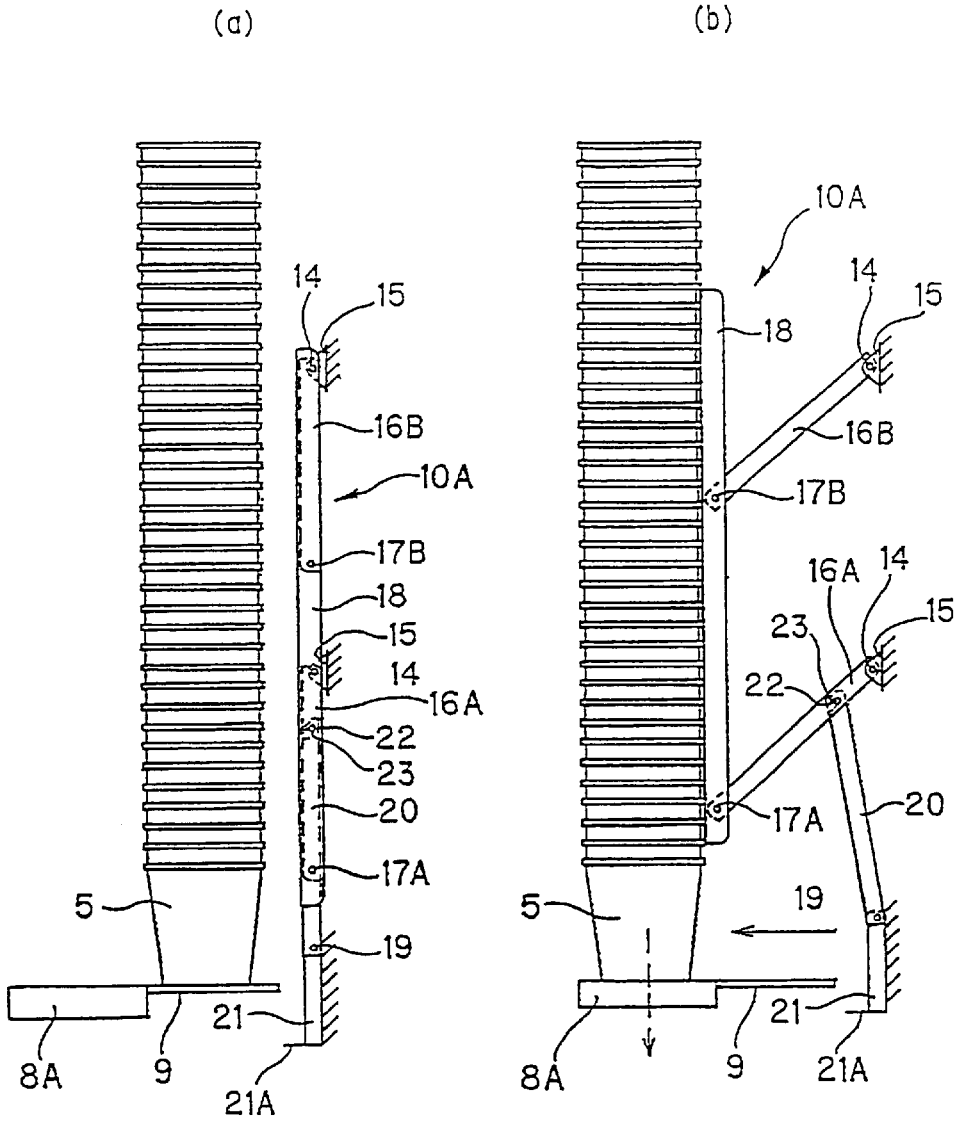
FIG. 7(*a*) is an explanatory view showing the waiting condition in the cup transport mechanism which is an embodiment of the invention.

In FIG. 7 showing a simplified behavior of the cup transport mechanism and in FIG. 7(*a*) showing the waiting condition in the behavior, the piled cups 5 (for L size) are installed on the conveyer 9. The cup transport mechanism 10A is in the liner form to the perpendicular direction along the supporting unit 15 and its surface in the cup contact side of the pushing material 18 is flat with the gap fill plate (not shown). In case th at all cups set in the cup supplying unit 8A are completely used, the cup sold-out signal is output to the vending control unit by a sensor (not shown) and the vending control unit indicates the conveyer 9 to run so that the piled cups 5 for supplement may be installed in a position corresponding to the cup supplying unit 8A in which all cups are sold out.

In FIG. 7(*b*) showing the initial driving condition of the cup transport mechanism 10A, the driving slider 21 is elevated by the driving material (not shown) to move the pin 22 of the link 20 connected to the pin 19 toward the direction of the piled cups 5 along the guide groove 23, whereby the pin 22 moves to the left side horizontally by the distance X3 in accordance with the shape of the guide groove 23. A clockwise rotating power round the pin 14 is given the link 16A depending on this transport. The rotating power is transmitted through the pushing material 18 to the link 16B to rotate the link 16B together with the link 16A. The pushing material 18 horizontally moves to the piled cups 5 based on the pin 14 of the links 16A and 16B until it is contact with the piled cups 5, and then, the piled cups horizontally moves from the conveyer 9 to the cup supplying unit 8A. When the elevating power given by the driving slider 21 is released after the piled cups 5 are moved, a rotating power in the counterclockwise direction is given the links 16A and 16B by the empty weight of the pushing material 18, the link 16*a* and the link 16B, whereby the link 16*a* and the link 16B are rotated to the waiting position as shown in FIG. 7(*a*). Since the center of gravity of the cup transport mechanism 10A, in the waiting position, is in the left side of horizontal direction to the pins 14, 22 and 19, a rotating power in the counterclockwise direction round the pin 14 is given by the empty weight of the cup transport mechanism 10A, whereby the links 16A, 16B, the pushing material 18, the link 19 and the driving slider 21, which constitute the cup transport mechanism 10A, are housed in the liner form to the perpendicular direction.

A cam material driven by a motor can be used as the driving material providing the elevating power to the driving slide 21.

According to the cup type automatic vending machine as described above, since the link 20 is extruded to the rotating side of the pushing material 18 by elevating it with the driving slider 21 in the initial driving condition of the cup transport mechanism 10A, 10B, 10C, the pushing material 18 can be driven by small driving force even if the cup transport mechanism 10A, 10B, 10C is thinner. In the waiting condition where the pushing material 18 is not driven, it is possible that the pushing material 18 is not extruded to the side of the piled cups 5 because the pushing power, by which the pushing material 18 is pushed to the fixed side of the support, is given based on the position of the center of gravity for the cup transport mechanism 10A, 10B, 10C and based on the installation of the pins 14, 19 and 22. Further, the plat surface is made between the pushing material 18 and the cup transport mechanism 10A, 10B, 10C by providing the gap fill plate 13 between the cup transport mechanism 10A, 10B, 10C, and the corner of the pushing material 18 which is contact with the piled cups 5 is made a curved surface, whereby deformation and circulation incapability of cup are prevented which are caused by contacting the piled cups 5 with the cup transport mechanism 10A, 10B, 10C owing to the small-sized cup accommodating unit 2.

In the above embodiments, the construction of the cup accommodating unit 2 for the piled cups of the three kinds of cups (S size, M size, L size) is explained, and they can be applied to a cup accommodating unit which accommodates the piled cups of single size or the piled cups of more different sizes.

According to the cup type automatic vending machine of the invention, as described above, the cup transport mechanism can be driven by smaller driving force and the cup accommodating unit can be made small size without deformation and circulation incapability of the cup, because the pushing material to push the piled cups from the fixed position to the cup separate position, a link pushing the piled cups by the pushing material, of which one end is movably supported and the other end is movably connected to the pushing material, said link is rotated round the one end in a fixed direction and the pushing material moves by the other end so as to push the piled cups, and a rotating power generating means provided in a fixed position between the ends of the link and rotating the link in a fixed direction by a driving force including a component in a direction perpendicular to the pushing direction of the pushing material are installed in the cup supplement device.

What is claimed is:

1. An automatic vending machine with a cup supplement device for providing supplemental cups by pushing out piled cups installed in a fixed position to a cup supply unit for supplying a drink supplying unit with a lowermost end cup of the piled cups, said cup supplement device comprising:

a pushing material to push out the piled cups from the fixed position to the cup supply unit;

a first link pushing the piled cups to the pushing material, said first link includes a first end that is movably supported and a second end that is movably connected to the pushing material, said first link being rotatable about a pivot point defined at the first end in a fixed direction and the pushing material being movable by the second end so as to push the piled cups; and a rotating power generator coupled to a position between the first and second ends of the first link, said rotating power generator for rotating the first link in a fixed direction by a driving force, said driving force including a component in a direction perpendicular to the pushing direction of the pushing material, wherein said rotating power generator includes a driving slider generating a driving force containing components in the pushing direction of the pushing material and in the direction perpendicular to the pushing direction of the pushing material, and a second link of which a first end is movably connected to the driving slider and of which a second end is connected to the first link by combination of a guide groove declined at a fixed angle at said position with a pin movable within the guide groove.

2. The automatic vending machine according to claim 1, wherein a center of gravity in said first and second links is set so that the rotating power is generated in an opposite direction to the pushing direction, when they are given the driving force from the driving slider.

3. An automatic vending machine with a cup supplement device for providing supplemental cups by pushing out piled cups installed in a fixed position to a cup supply unit for supplying a drink supplying unit with a lowermost end cup of the piled cups, said cup supplement device comprising:

a pushing material to push out the piled cups from the fixed position to the cup supply unit;

a first link pushing the piled cups to the pushing material, said first link includes a first end that is movably supported and a second end that is movably connected to the pushing material, said first link being rotatable about a pivot point defined at the first end in a fixed direction and the pushing material being movable by the second end so as to push the piled cups; and a rotating power generator coupled to a position between the first and second ends of the first link, said rotating power generator for rotating the first link in a fixed direction by a driving force, said driving force including a component in a direction perpendicular to the pushing direction of the pushing material, wherein said pushing material makes a flat surface with a gap fill plate provided between said pushing material and an adjacent pushing plate, which is a same flat surface as an inner wall of said cup supplement device.

4. The automatic vending machine according to claim 3, wherein a corner of said pushing material which is in contact with the piled cups is a curved surface or a round corner.

5. The automatic vending machine of claim 1, wherein said pushing material includes a plate.

6. The automatic vending machine of claim 3, wherein said pushing material includes a plate.

7. A cup supplement device for providing supplemental cups by pushing out piled cups installed in a fixed position to a cup supply unit for supplying a drink supplying unit with a lowermost end cup of the piled cups, comprising:

a pushing material adapted to move a pile of cups, said pushing material capable of moving between a first position and a second position; and a driving mechanism for moving said pushing material from said first position to said second position, said driving mechanism includes a driving slider for sliding on a surface between a first location and a second location, wherein said apparatus is configured such that said pushing material can be driven from said second position to said first position solely by gravitational force.

8. The apparatus of claim 7, wherein said pushing material is spaced away from the pile of cups in said first position and engages said pile of cups in said second position.

9. The apparatus of claim 7, wherein said apparatus is configured such that said pushing material is driven from said second position to said first position solely by gravitational force.

10. The apparatus of claim 7, wherein said driving mechanism further includes:

a first link having a first end and a second end; and a second link having a third end and a fourth end, wherein said first end is coupled to said pushing material, said third end is coupled to said first link at an intermediate position between said first and second end, and said fourth end is coupled to said driving slider, whereby sliding movement of said driving slider from said first location to said second location effects movement of said first and second links such that said pushing material moves from said first position to said second position.

11. The apparatus of claim 10, wherein the sliding movement of said driving slider effects rotational movement of at least one of said first and second links.

12. The apparatus of claim 10, wherein one of said first link and said second link includes a pin extending therefrom and the other one of said first link and said second link includes a groove for guiding movement of said pin between a first point and a second point within said groove.

13. The apparatus of claim 12, wherein said pin and groove are configured such that the sliding movement of said driving slider effects movement of said pin from said first point to said second point within said groove whereby said first link rotates.

14. The apparatus of claim 12, wherein said groove is completely spaced from a peripheral edge of said second link such that movement of said pin is contained within said second link.

15. The apparatus of claim 14, wherein said pin and groove are configured such that the sliding movement of said driving slider effects movement of said pin from said first point to said second point within said groove whereby said first link rotates, said groove including an inner surface for contacting said pin at said second point whereby said second link rotates.

16. The apparatus of claim 10, wherein the sliding movement of said driving slider effects clockwise rotation of said first link and counter-clockwise rotation of said second link.

17. The apparatus of claim 10, wherein said driving slider slides vertically between said first location and said second location.

18. The apparatus of claim 10, wherein said second end is fixed to an external surface so as to define a pivot point about which said first link is rotatable.

19. The apparatus of claim 7, wherein said driving mechanism further includes a cam material for driving the driving slider from said first location to said second location.

* * * * *